US009543657B2

(12) United States Patent
Cox

(10) Patent No.: US 9,543,657 B2
(45) Date of Patent: Jan. 10, 2017

(54) UHF SATELLITE COMMUNICATIONS ANTENNA

(71) Applicant: R.A. Miller Industries, Inc., Grand Haven, MI (US)

(72) Inventor: Roger A. Cox, Spring Lake, MI (US)

(73) Assignee: R.A. Miller Industries, Inc., Grand Haven, MI (US)

( * ) Notice: Subject to any disclaimer, the term of this patent is extended or adjusted under 35 U.S.C. 154(b) by 106 days.

(21) Appl. No.: 14/667,605

(22) Filed: Mar. 24, 2015

(65) Prior Publication Data

US 2015/0295321 A1 Oct. 15, 2015

Related U.S. Application Data

(60) Provisional application No. 61/979,777, filed on Apr. 15, 2014.

(51) Int. Cl.

| | |
|---|---|
| ***H01Q 9/28*** | (2006.01) |
| ***H01Q 1/42*** | (2006.01) |
| ***H01Q 1/32*** | (2006.01) |
| ***H01Q 21/24*** | (2006.01) |

(52) U.S. Cl.

CPC ..... *H01Q 9/28* (2013.01); *H01Q 1/3275* (2013.01); *H01Q 1/42* (2013.01); *H01Q 9/285* (2013.01); *H01Q 21/245* (2013.01)

(58) Field of Classification Search

CPC ..... H01Q 1/3275; H01Q 1/42; H01Q 9/285; H01Q 21/245

See application file for complete search history.

(56) References Cited

U.S. PATENT DOCUMENTS

| | | | | |
|---|---|---|---|---|
| 3,701,157 | A | 10/1972 | Uhrig | |
| 6,028,563 | A * | 2/2000 | Higgins | H01Q 1/246 343/797 |
| 7,567,215 | B1 | 7/2009 | All et al. | |
| 9,118,116 | B2 * | 8/2015 | Apostolos | H01Q 1/36 |

FOREIGN PATENT DOCUMENTS

| | | | |
|---|---|---|---|
| DE | 202004008770 | U1 | 9/2004 |
| WO | 2013/022906 | A1 | 2/2013 |

* cited by examiner

*Primary Examiner* — Hoang V Nguyen
(74) *Attorney, Agent, or Firm* — McGarry Bair PC

(57) ABSTRACT

A UHF satcom antenna comprises a hollow cylinder; an annular substrate disposed on a base of the hollow cylinder; a circular substrate coplanar and concentric to the annular substrate; a plurality of bow-tie antenna elements; a plurality of rectangular antenna elements and a plurality of open-sleeve elements. The antenna system includes at least one feed line extending through the hollow cylinder and the circular substrate and electrically connects to the bow-tie elements. The hollow cylinder may comprise a dielectric material. Provided on the annular substrate, the bow-tie elements extend radially outward from the center of the annular substrate. The rectangular elements are electrically coupled to the plurality of bow-tie antenna elements and are provided on the outer surface of the hollow cylinder. Provided on both the annular substrate and the outer surface of the hollow cylinder, the open-sleeve elements act as parasitic antenna elements for the bow-tie antenna system.

10 Claims, 4 Drawing Sheets

UHF SATELLITE COMMUNICATIONS ANTENNA

CROSS-REFERENCE TO RELATED APPLICATION

This application claims the benefit of U.S. Provisional Patent Application No. 61/979,777, filed Apr. 15, 2014, which is incorporated herein by reference in its entirety.

BACKGROUND

For radio frequency communications including the transmission and reception of signals encoded in electromagnetic radiation, antennas are typically designed to maintain desired radiation patterns over several octaves of bandwidth. Antenna structures for radio communication have been well known in the art for decades and include log-periodic and spiral radiating structures.

BRIEF DESCRIPTION

In one aspect, a UHF satellite communications antenna includes a cylinder having a longitudinal axis. An annular dialectic substrate is on an end of the cylinder and a circular substrate is coplanar and concentric with the annular dialectic substrate. A set of opposed conductive bow tie elements extends radially on the annular dialectic substrate from the circular substrate. Open sleeve elements extend radially on the annular dialectic substrate from the circular substrate on either side of each of the set of opposed conductive bow-tie elements, spaced from the set of opposed conductive bow-tie elements, and electrically coupled to each other. A feed line extends parallel to the longitudinal axis through the cylinder and the circular substrate and is electrically coupled with the set of opposed conductive bow-tie elements.

DETAILED DESCRIPTION

Figure 1:
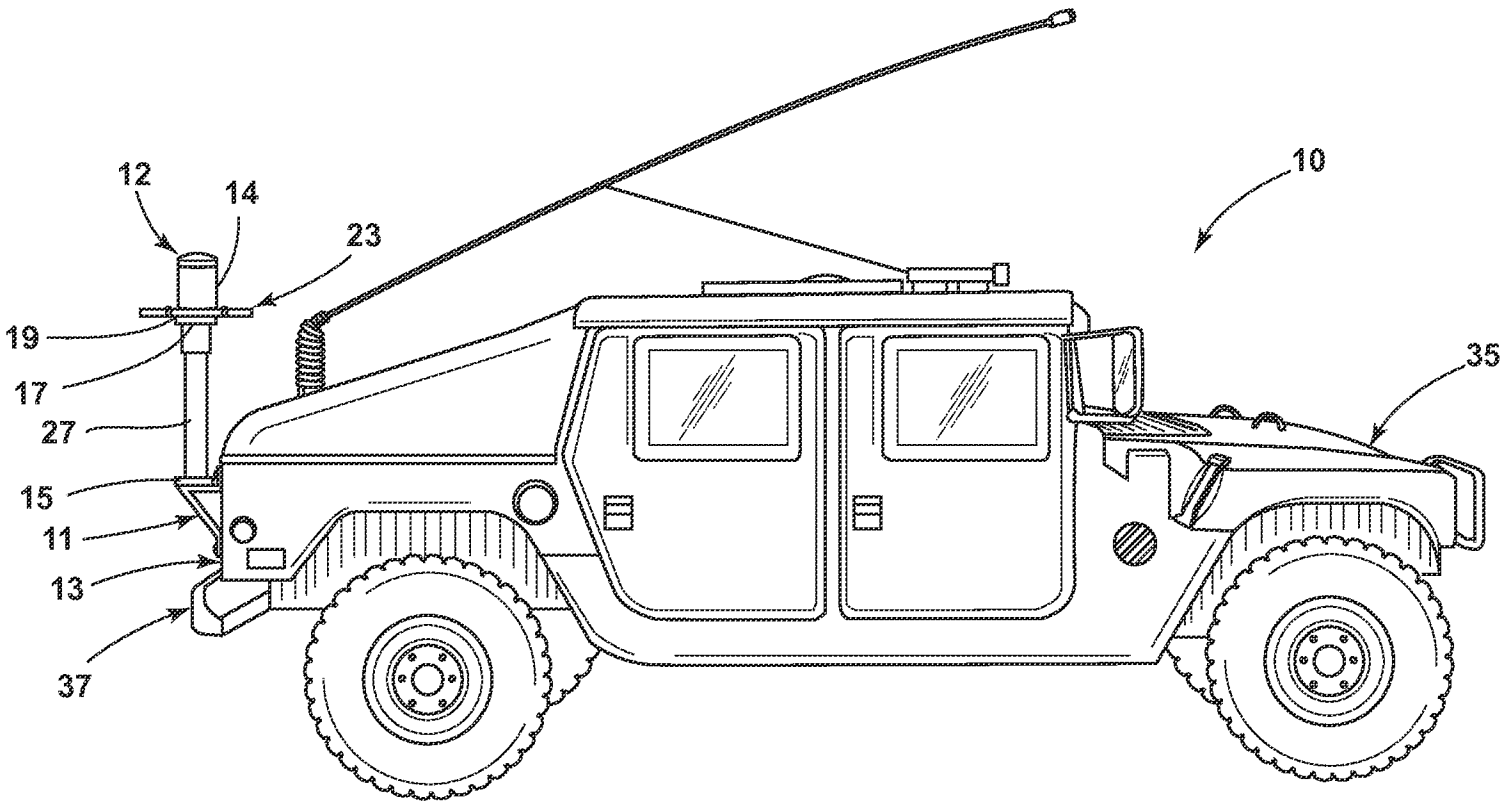
FIG. 1 shows a perspective view of a vehicle equipped with a bow-tie antenna with open sleeves for communications according to an embodiment of the invention.

Referring now to FIG. 1, a vehicle 10 has a UHF satcom antenna 12 and a ground plane 23 mounted on a riser 27 extending from a bracket 11 which is located at a rear surface 13 of the vehicle in a typical environment for an embodiment of the invention. The bracket 11 is conductive, typically being formed of sheet metal and mounted to the vehicle 10 in a conventional manner such as in the form of a weld, bolt, rivet, fastener or screw. It may be mounted to or above (as shown) a bumper 37 on the vehicle. The riser 27 is a hollow metal tube that may have a height of 12 to 48 inches. A proximal end 15 of the riser 27 attaches directly to the bracket 11 and a distal end 17 supports the ground plane 23 and the UHF satcom antenna 12. The distal end 17 preferably includes a flat surface 19 to vertically support a ground plane 27 and antenna 12. Preferably, the riser 27 will be sized so that when the antenna 12 is mounted thereto, it will project above any metal surface of the vehicle 10 to minimize interference for optimal performance. The ground plane 23 is disposed between the antenna 12 and the riser 27, and is mounted to the riser 27 in a conventional manner such as in the form of a weld, bolt, rivet, fastener or screw. It will be understood that the UHF satcom antenna 12 is at least one of perhaps more than one that may be mounted to the vehicle 10. Moreover, it will be understood that the location is not limited to the location shown in FIG. 1; at least one UHF satcom antenna 12 may be mounted near or on either side of the engine compartment 35, for example, typically with a riser 27.

The vehicle 10 may include equipment to engage in radio frequency communications. Radio frequency communications may include the transmission or reception of radio broadcasts from a variety of equipment and modalities including hand-held, portable, two-way radio transceivers (i.e. "walkie-talkies"), marine and aviation environments, fixed base stations and satellite communications. To transmit a radio signal, the antenna 12 converts electric currents provided by a radio transmitter (not shown) into radio waves. Conversely, to receive a radio signal, the antenna 12 intercepts a portion of the power of a remotely broadcast electromagnetic wave and generates a voltage that is applied to a radio receiver (not shown). In this way, the antenna 12 may facilitate satellite communications.

The outer element of the antenna 12 is the radome 14. The radome 14 is a structural, weatherproof enclosure that protects the internal elements of the antenna 12. Due to material composition, the radome 14 minimally attenuates the power and integrity of the transmitted and received radio frequencies signals. In other words, the radome 14 is substantially transparent to radio waves. Typical materials used in the construction of the radome may include fiberglass and PTFE-coated fabric, though other low loss materials may be used. As shown, the radome 14 is substantially cylindrical in shape, though other shapes including spherical, ovoid, ellipsoid, geodesic and combinations thereof may be used. Radomes protect antenna structures such as dipoles contained therein from weather. For example, the radome 14 may prevent ice and freezing rain from accumulating directly onto metal surfaces of dipole antenna structures.

Figure 2:
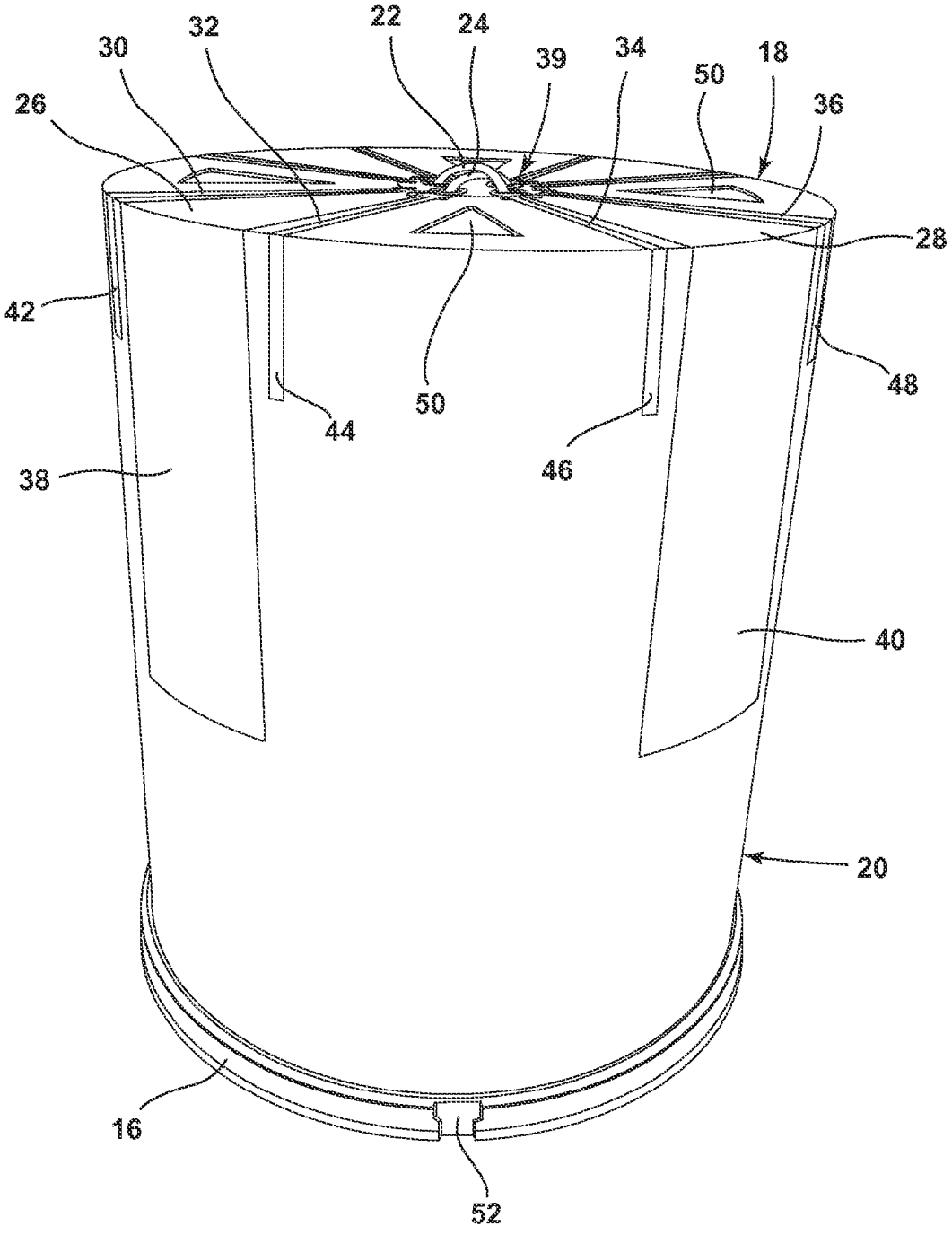
FIG. 2 shows a perspective view of the bow-tie antenna with open sleeves.

Referring now to FIG. 2, a perspective view of the antenna 12 beneath the radome 14 is shown. Elements of the antenna 12 include an annular substrate 18, a hollow cylinder 20 and a circular substrate 39. Two feed lines 22, 24 extend through the circular substrate 39, which is coplanar and concentric to the annular substrate 18. The annular substrate 18 and circular substrate 39 are connected to the hollow cylinder 20 such that the substrates 18, 39 form the upper base of the hollow cylinder 20.

A set of bow-tie (or butterfly) antenna elements 26, 28 extend radially outward from the center of the annular substrate 18. Each bow-tie antenna element 26, 28 is a flat, triangular-shaped element. Provided on either side of each bow-tie element 26 and 28 respectively, open-sleeve elements 30, 32 and 34, 36 are thin, rectangular-shaped strips, electrically coupled to each other, preferably via traces on the other side of the circular substrate 39. Open-sleeve elements 30, 32, 34, 36 are parasitic antenna elements; that is, they are not physically coupled to the bow-tie elements 26, 28. Preferably, the annular substrate 18 is a standard printed circuit board (PCB) substrate such as FR-4 upon which the bow-tie antenna elements 26, 28 and open-sleeve elements 30, 32, 34, 36 are placed. The bow-tie antenna elements 26, 28 and open-sleeve elements 30, 32, 34, 36 are preferably formed as microstrips whereby a pattern of metallization in the shape of the desired antenna element is formed on the substrate.

The annular substrate 18 may include voids 50 without loss of mechanical support or rigidity of the annular substrate 18. The voids 50 may provide access to the interior cavity of the antenna 12 and other structural elements may be added to reinforce the antenna 12. For example, foam or fiberglass may fill some or all of the internal volume of the antenna 12.

Rectangular antenna elements 38, 40 extend radially along and project onto the outer surface area of the hollow cylinder 20. One side of each rectangular antenna element 38, 40 aligns with the top base of the hollow cylinder 20 at the outer edge of a corresponding bow-tie element 26, 28, respectively. Provided on either side of each rectangular element 38, 40 respectively, open-sleeve element extensions 42, 44 and 46, 48 are thin, rectangular-shaped strips. One side of each open-sleeve element extension 42, 44, 46, 48 aligns with the top base of the hollow cylinder 20 at the outer edge of a corresponding open-sleeve element 30, 32, 34, 36, respectively disposed on the annular substrate 18.

For the reasons described above with respect to the construction of the radome 14, the hollow cylinder 20 may comprise fiberglass, though any type of low loss dielectric material (plastic, Teflon, etc.) may be used depending upon the implementation. The rectangular antenna elements 38, 40 and open-sleeve element extensions 42, 44, 46, 48 are preferably formed with adhesive-backed tin-plated copper foil.

The mounting plate attachment 16 may include one or more open ended, elongated T-slots 52 to enable adaptable mounting of the antenna 12 to different-sized and configured platforms. In this way, the antenna 12 may be mounted to many different platforms.

Figure 3:
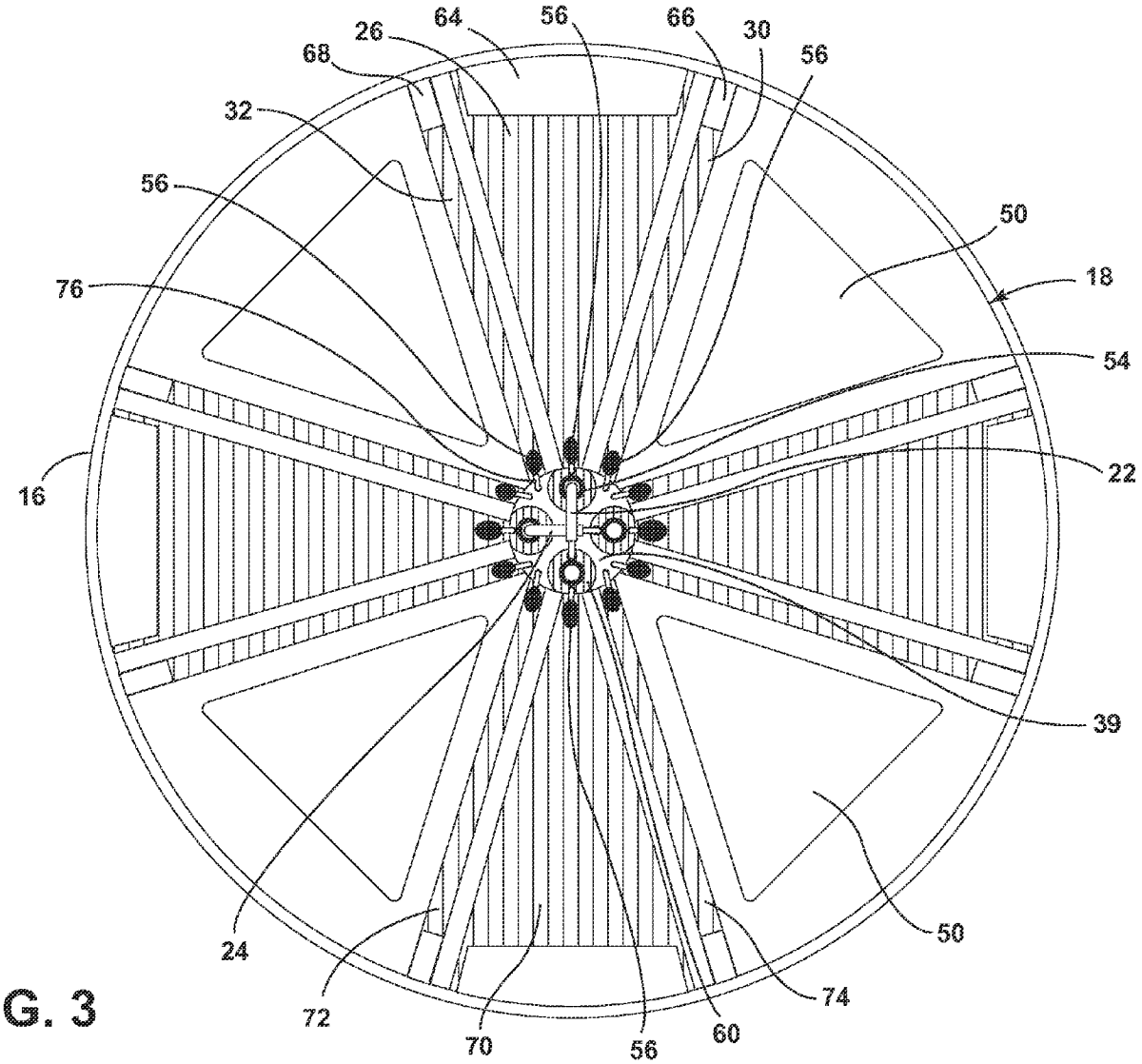
FIG. 3 shows a top view of the bow-tie antenna with open sleeves.

Referring now to FIG. 3, a top view of the antenna 12 is shown. Two feed lines 22, 24 extend through the circular substrate 39. The feed lines 22, 24 are preferably implemented by a pair of equal length coaxial cables though other feed line structures are contemplated and include twin-lead, ladder line, stripline, microstrip and waveguide. The center conductor and shield of the cables are electrically coupled to opposing conductive pads. For example, the center conductor of the coaxial feedline 22 may be soldered to a first conductive pad 60 and the shielding soldered to a second conductive pad 54. Each conductive pad 54, 60 is electrically coupled to a corresponding bow-tie element 26, 70.

All of the open-sleeve elements 30, 32, 72 and 74 are electrically coupled to the circular substrate 39. As shown in FIG. 3 the open-sleeve elements 30, 32, 72 and 74 are physically connected to the circular substrate 39 via a solder connection 56 and wire connector 76.

As described above in FIG. 2, each antenna element on the annular substrate 18 including the bow-tie elements and the open-sleeve elements are electrically coupled to a corresponding element disposed on the hollow cylinder 20. A bow-tie element 26 may be coupled to a rectangular antenna element (e.g. rectangular element 38 in FIG. 2) by an intermediate conducting element 64. Similarly, an open-sleeve element 30, 32 disposed on the annular substrate 18 may be coupled to a corresponding open-sleeve element (e.g. open-sleeve elements 42 and 44 in FIG. 2) by intermediate conducting elements 66 and 68. The intermediate conducting elements 64, 66, 68 may be implemented by adhesive-backed tin-plated copper foil, solder or any material capable of carrying the electromagnetic signals at the desired wavelength(s).

A pair of opposed bow-tie elements (e.g. dipole elements 26 and 70) including the electrically coupled corresponding rectangular elements on the surface of the hollow cylinder form a dipole. As shown in FIG. 3, four bow-tie elements may be configured to form two orthogonal dipoles. The two orthogonal dipoles are driven 90 degrees out of phase with respect to each other to produce right-hand circularly polarized radiation that is directed upward along the axis of the hollow cylinder 20 where the axis of the hollow cylinder is determined by the line formed by the centers of the bases of the cylinder. By coupling the feed lines 22, 24 (i.e. coaxial cables) to a broadband 90-degree hybrid coupler (not shown), one feed line may be set to 0 degrees phase and the other feed line may be set to −90 degrees. In this way, the antenna 12 (with its two pairs of crossed bow-tie dipole array elements) may be configured for circular polarity; either right-handed or left-handed circular polarity depending upon the implementation.

Two open-sleeve elements, where each open-sleeve element includes the electrically coupled combination of the open-sleeve element on the annular substrate 18 and the hollow cylinder 20, are parasitically coupled to each of the four bow-tie dipole elements. Each pair of open-sleeve elements are in-phase with each corresponding bow-tie dipole. Consequently, when the bow-tie dipoles are driven 90 degrees out of phase, the parasitic open-sleeve elements also are 90 degrees out of phase with the orthogonal set of open-sleeve elements.

The bow-tie dipoles have a resonance close to 260 MHz, while the open-sleeve elements have a resonance close to 340 MHz. The combination of the bow-tie dipoles and parasitic open-sleeves provide a low voltage standing wave ratio (VSWR) from 243 through 380 MHz which corresponds to the UHF bands associated with channels for satellite communications.

Figure 4:
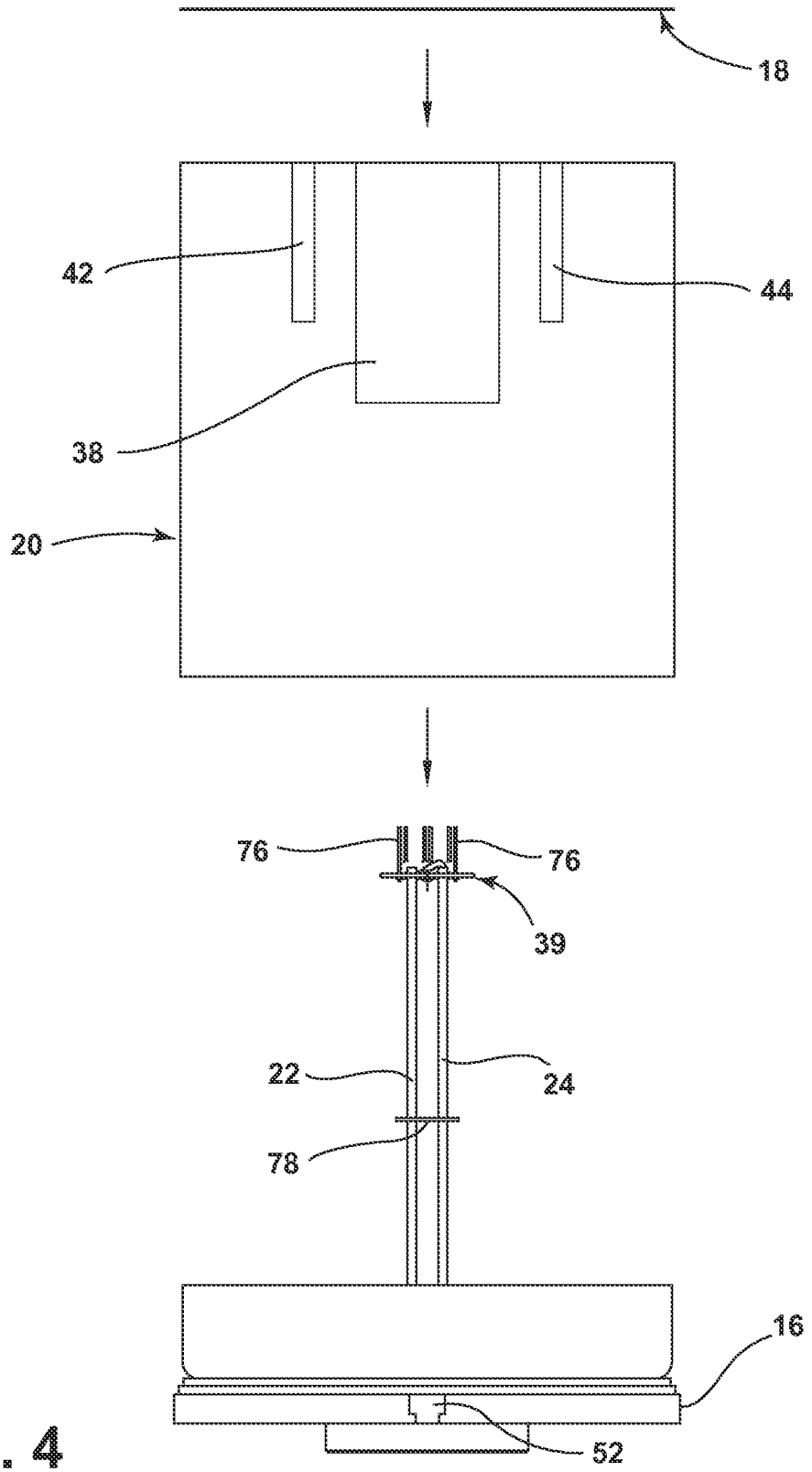
FIG. 4 shows an exploded elevation view of the bow-tie antenna.

Referring now to FIG. 4, an exploded view of the antenna is shown. The annular substrate 18 is placed at a base of the hollow cylinder 20. Open-sleeve elements 42, 44 and rectangular elements 38 are aligned with the corresponding antenna elements on the top surface of the annular substrate 18. The hollow cylinder 20 is placed over top of the coaxial feed lines 22 and 24. Spacing between the feed lines 22 and 24 is maintained by coaxial spacers 78. The annular substrate 18 is aligned to be concentric and coplanar with the circular substrate 39. Upon alignment of the substrates, the connecting wires 76 are bent to connect the open-sleeve elements to the circular substrate 39 and soldered. The circular substrate 39, the connecting wires 76, the coaxial feed lines 22, 24 running to the circular substrate 39, and the between the coaxial spacers 78 work together to form a balun. The interior volume of the antenna may be filled with a structurally supporting material as described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A UHF satellite communications antenna comprising:

a cylinder having a longitudinal axis;

an annular dielectric substrate on an end of the cylinder;

a circular substrate coplanar and concentric with the annular dielectric substrate;

a set of opposed conductive bow tie elements extending radially on the annular dielectric substrate from the circular substrate;

open sleeve elements extending radially on the annular dielectric substrate from the circular substrate on either side of each of the set of opposed conductive bow tie elements, spaced from the set of opposed conductive bow tie elements, and electrically coupled to each other; and a feed line extending parallel to the longitudinal axis through the cylinder and the circular substrate and electrically coupled with the set of opposed conductive bow tie elements.

2. The UHF satellite communications antenna of claim 1 wherein the set of opposed conductive bow tie elements includes two pairs of bow tie elements disposed orthogonally on the annular dielectric substrate to form two orthogonal dipoles, each pair electrically coupled to its own feed line.

3. The UHF satellite communications antenna of claim 2 wherein the feed lines are set to 90 degrees out of phase with each other.

4. The UHF satellite communications antenna of claim 2 wherein the circular substrate, the coaxial feed lines, and connections among the open sleeve elements work together to form a balun.

5. The UHF satellite communications antenna of claim 1 further comprising a set of antenna elements on the outer surface of the cylinder electrically coupled with the set of opposed conductive bow tie elements.

6. The UHF satellite communications antenna of claim 5 further comprising a set of open-sleeve element extensions on the outer surface of the cylinder electrically coupled with the open sleeve elements and spaced from the set of antenna elements.

7. The UHF satellite communications antenna of claim 1 wherein the set of opposed conductive bow tie elements have a resonance close to 260 MHz and the open-sleeve elements have a resonance close to 340 MHz.

8. The UHF satellite communications antenna of claim 1 further comprising a mounting plate attachment on the other end of the cylinder.

9. The UHF satellite communications antenna of claim 1 wherein the cylinder is filled with foam.

10. The UHF satellite communications antenna of claim 1 further comprising a radome over the cylinder.

* * * * *